US006281771B1

(12) United States Patent
Turner et al.

(10) Patent No.: US 6,281,771 B1
(45) Date of Patent: Aug. 28, 2001

(54) MOLDED CASE POWER SWITCH WITH SECONDARY COVER REMOVABLY SECURED BY CAPTURED ROTATABLE NUT

(75) Inventors: David Curtis Turner, Imperial; David Michael Olszewski, McKees Rocks, both of PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/635,052

(22) Filed: Aug. 9, 2000

(51) Int. Cl.[7] ..... H01H 13/04
(52) U.S. Cl. ..... 335/202; 200/293
(58) Field of Search ..... 335/132, 202; 200/293–312

(56) References Cited

U.S. PATENT DOCUMENTS

| | | | | |
|---|---|---|---|---|
| 4,129,843 | * | 12/1978 | Keller et al. | 335/174 |
| 4,860,162 | * | 8/1989 | DeVizzi | 335/202 |
| 4,929,920 | * | 5/1990 | Meiners et al. | 335/202 |
| 5,910,760 | | 6/1999 | Malingowski et al. . | |

FOREIGN PATENT DOCUMENTS 6-124639 * 5/1994 (JP) .

* cited by examiner

*Primary Examiner*—Lincoln Donovan
(74) *Attorney, Agent, or Firm*—Martin J. Moran

(57) ABSTRACT

The secondary cover of a molded case electric power switch housing is removably secured in place to enclose cavities in a primary cover for auxiliary devices by an attachment assembly. The attachment assembly includes one or more studs having a first end section with self-tapping threads which fix the studs to the molded primary cover with a second end section having a conventional screw thread projecting outward from the top face of the primary cover. The attachment assembly also includes fasteners in the form of nuts rotatably captured in mounting holes in the secondary cover. Each nut includes a head configured for grasping by a tool and an integral cylindrical collar which extends through the associated mounting hole in the secondary cover. The nuts are retained in place by an outward flair on the free end of the collar. The nuts are provided with a central bore with a thread complimentary to the thread on the second end section of the stud so that with the secondary cover positioned over the primary cover, the nuts are rotated to engage the threads on the stud and thereby firmly secure the secondary cover over the primary cover. The durable studs and nuts experience little wear over repeated installation and removal of the secondary cover.

12 Claims, 3 Drawing Sheets

LINE
LOAD
1
3
5
7
9
11
13
15
17
19
21
23
25
27
29
31
33
35
37
39
41
43
45
47
49
51
53
55
57
59
61
63
65

MOLDED CASE POWER SWITCH WITH SECONDARY COVER REMOVABLY SECURED BY CAPTURED ROTATABLE NUT

BACKGROUND OF THE INVENTION

1. Field of the Invention

This invention relates to power switches for interrupting current in electric power circuits. More particularly, it relates insulated molded cases for such switches having a removable secondary cover which encloses recesses for auxiliary devices in the primary cover, and an assembly for removably securing the secondary cover over the primary cover.

2. Background Information

Power switches, such as circuit breakers, transfer switches and the like, used in low power (600 volts and below) electric power distribution systems, commonly have a housing molded of an electrically insulative resin and are, therefore, referred to as molded case circuit breakers, transfer switches and the like. The molded housing includes a base and a cover which together form an enclosure in which are mounted one or more switch poles, a switch operating mechanism and, where appropriate, a trip device. Typically, the molded case circuit breaker has a trip device that responds to short circuits and usually to persistent over current conditions also, and opens the main switch contacts interrupting current.

Often, it is desirable to provide additional features on the switch, sometimes as options. Such additional features include a remote trip, an auxiliary switch which provides an indication of the open or closed state of the main switch contacts, and/or a bell alarm which provides an indication that the trip device has been activated. In some installations, it is desirable to have the switch open on under voltage or off frequency conditions to prevent damage to a protected load.

These additional features can be incorporated within the switch housing formed by the base and cover. However, in some instances, the devices providing the desired features are received in cavities formed in the cover of the housing. In this latter case, a secondary cover encloses the cavities in what has become the primary cover. This secondary cover should be easily removable for inserting, removing or servicing the devices providing the additional features. Typically, the secondary cover is removably secured to the molded primary cover by screws. However, screws either require threaded inserts in the primary cover, which increases the cost and manufacturing steps or they are self tapping. When self tapping screws are used, the threads in the molded resin can be stripped out by repeated insertion and removal. In either case, the screws can be lost when removed.

There is a need, therefore, for an improved molded case power switch housing and particularly for an improved arrangement for removably attaching a secondary cover to the molded housing.

There is a further need for such an improved molded case power switch housing in which there are no loose fasteners to become lost or hard to locate.

There is another need for such an improved molded case power switch that does not require repeated insertion and removal of self-tapping screws into the molded housing.

There is yet another need for an improved molded case power switch housing which is economical to manufacture and easy to use.

SUMMARY OF THE INVENTION

These needs and others are satisfied by the invention which is directed to a molded case power switch housing in which a secondary cover is removably secured over the primary cover to enclose cavities in the primary cover containing auxiliary devices by an attachment assembly comprising at least one, and preferably a plurality, of studs each having a first end non-rotatably fixed in the primary cover and a second end projecting from the top face of the primary cover and aligned with an associated mounting hole in the secondary cover. The second end of each of the studs carries a first engagement member. The attachment assembly further includes at least one, and again preferably a plurality of fasteners captured in an associated mounting hole in the secondary cover. These fasteners have a second engagement member engaging and disengaging the first engagement member on the associated stud to secure the secondary cover to and release the secondary cover from the primary cover. Preferably, the fasteners are rotatably captured in the associated mounting hole in secondary cover for rotatable engagement and release of the first engagement members by the second engagement members.

In the currently most preferred embodiment of the invention, the engagement member on the second end of each stud is a thread and each of the fasteners is a nut in which the second engagement member is a complementary thread. Each of the nuts has a non-circular head which is preferably polygonal and most preferably hexagonal. The nuts also have a cylindrical collar seated in the associated mounting hole in the secondary cover, and a retainer on the free end of the collar which captures the collar in the mounting hole. In the preferred embodiment of the invention, the retainer is an outward flare on the free end of the collar.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

The invention will be described as applied to a housing for a molded case circuit breaker; however, it will become evident that the invention has application to molded case housings for other types of power switches such as, for instance, transfer switches or disconnect switches.

Figure 1:
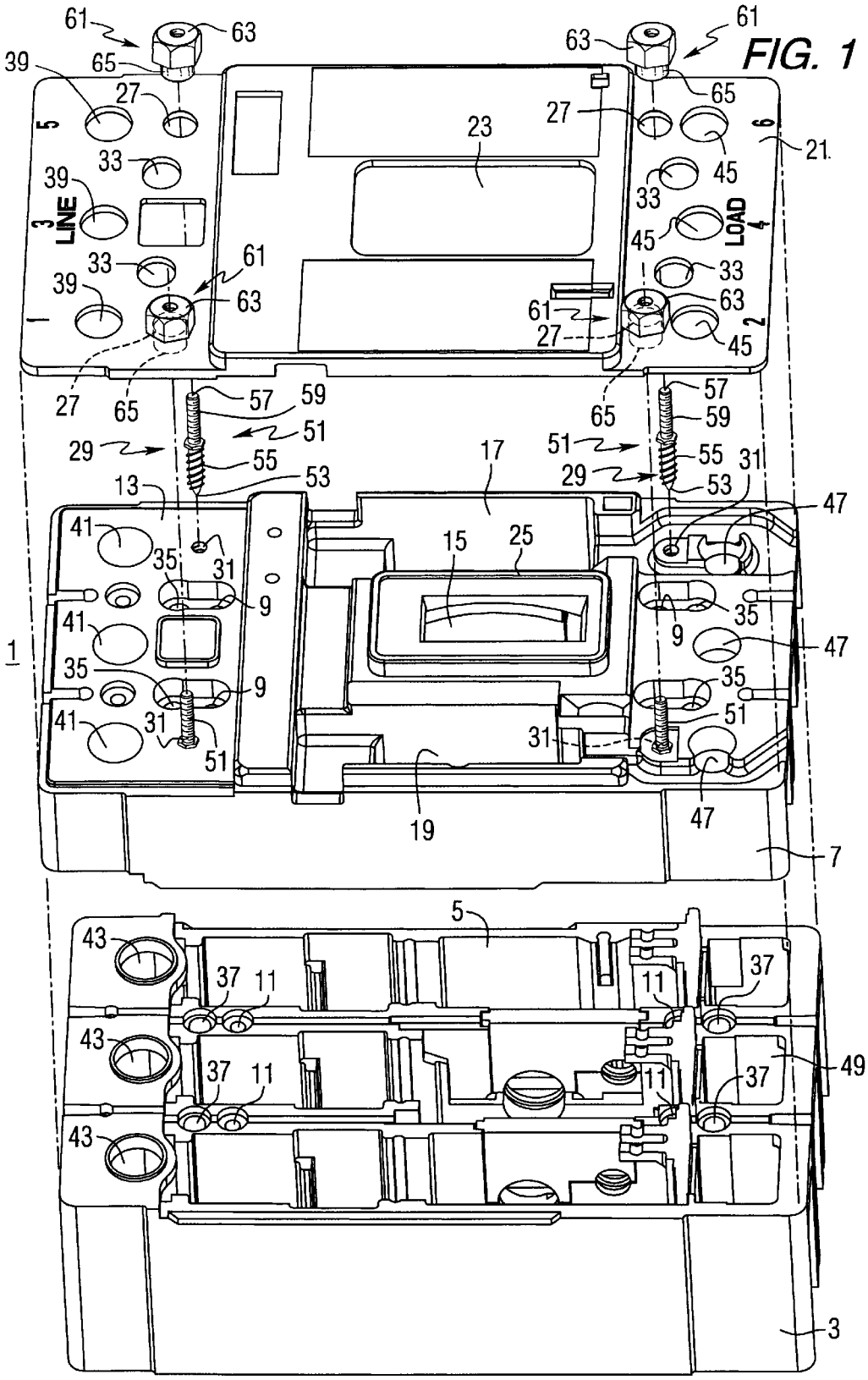
FIG. 1 is in exploded isometric view of a molded Case circuit breaker housing in accordance with the invention.
Figure 2:
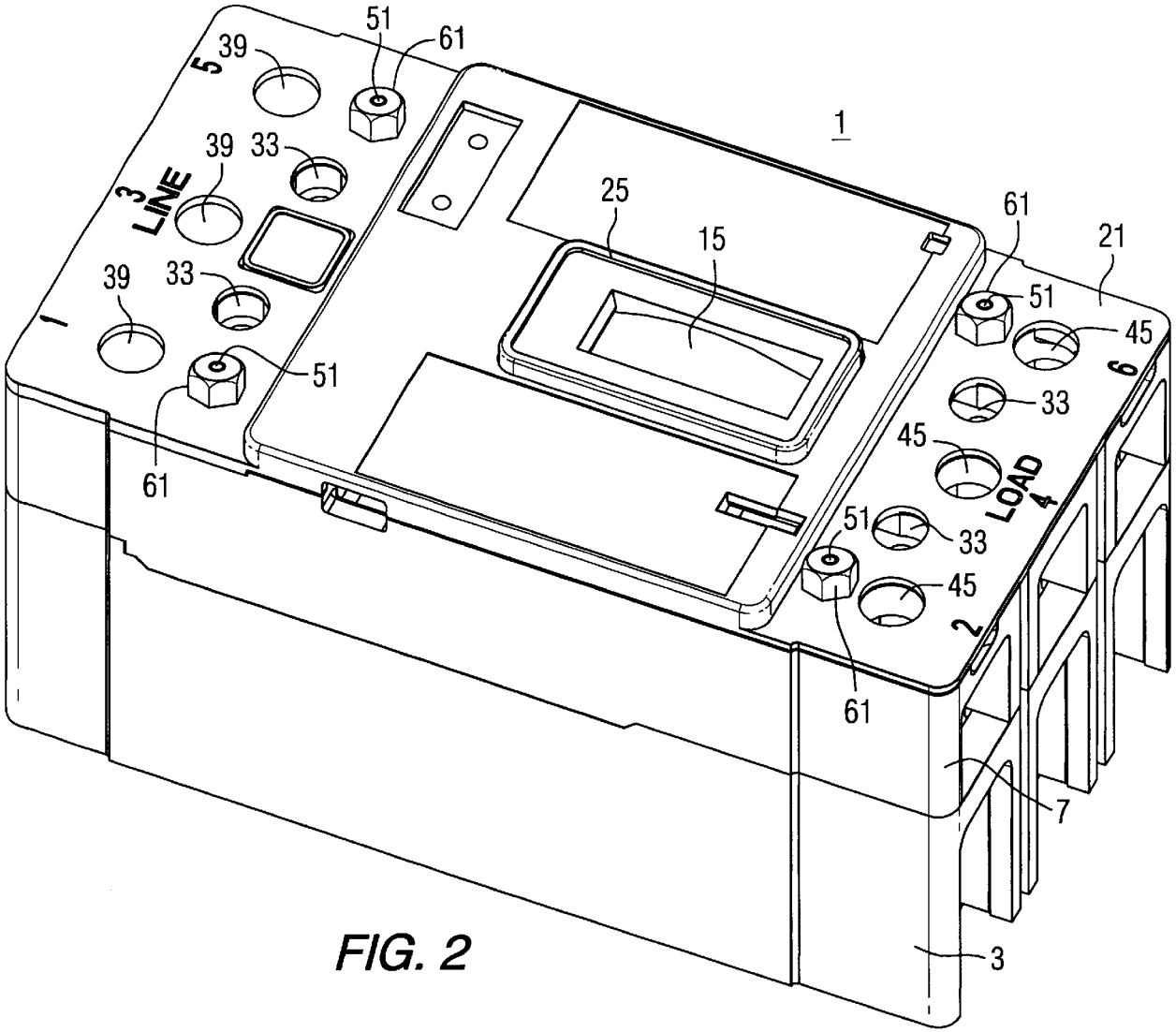
FIG. 2 is an assembled isometric view of the molded case circuit breaker housing of FIG. 1.
Figure 3:
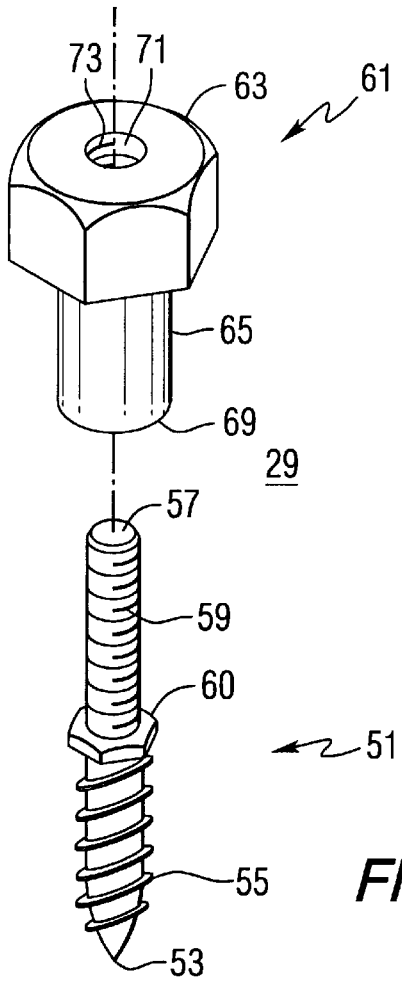
FIG. 3 is an exploded isometric view of an attachment assembly in accordance with the invention.
Figure 4:
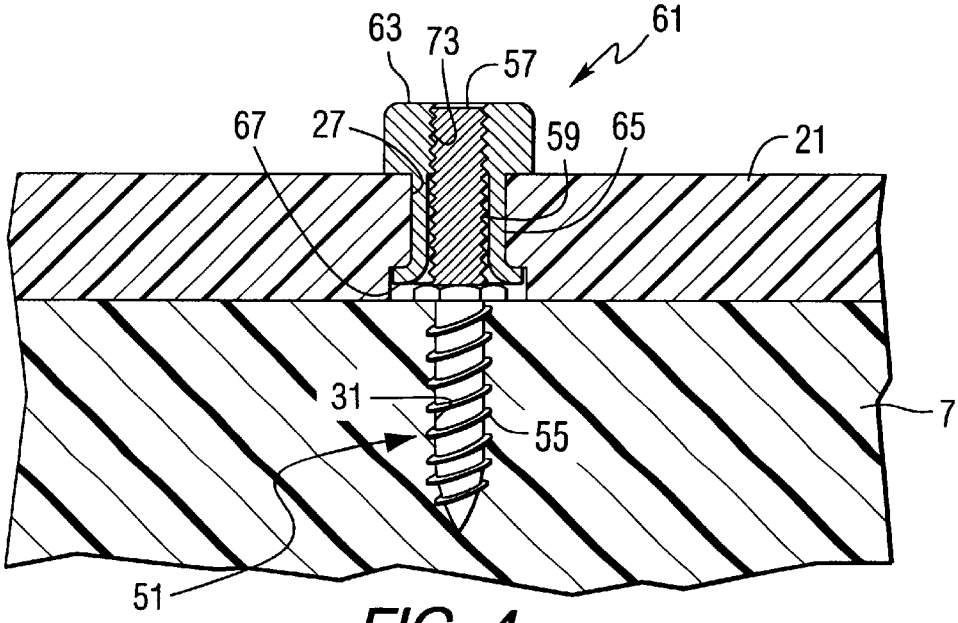
FIG. 4 is a fractional vertical cross-section through a portion of the housing showing the secondary cover secured to the primary cover by the attachment assembly of the invention.

Referring to FIGS. 1 and 2, the molded case circuit breaker housing 1 includes a molded base 3 having an open top 5. The housing 1 also includes a molded primary cover 7 which seats over the open top 5 of the base 3 to form an enclosure in which circuit breaker poles and an operating mechanism (neither shown) are housed. The primary cover 7 is secured to the base 3 by screws (not shown) which extend through openings 9 in the top cover and are threaded into mating holes 11 in the base as is well known. The top face 13 of the primary cover 7 has an opening 15 for a handle of the operating mechanism (not shown). This top face 13 of the primary cover 7 also has one or more cavities 17 and 19 in which auxilary devices such as an undervoltage relay, a shunt trip module, an auxiliary switch, a bell alarm, or the like (none shown) can be inserted to provide optional functions for the circuit breaker.

The molded case circuit breaker housing 1 further includes a secondary cover 21 which seats on the primary cover 7 and covers the cavities 17 and 19 to enclose any auxiliary devices provided in these cavities. The secondary cover 21 has a handle opening 23 which registers with the handle opening 15 in the primary cover but is larger so that the escutcheon 25 around the handle opening 15 projects through the handle opening 23.

The secondary cover 21 has one or more, in this case four, mounting holes 27 which are engaged by an attachment assembly 29 to be described in detail to secure the secondary cover 21 to the primary cover 7. The primary cover 7 has corresponding mounting holes 31 aligned with the mounting holes 27 in the secondary cover. The secondary cover has additional apertures 33 which align with corresponding apertures 35 in the top cover and 37 in the base and through which elongated fasteners (not shown) can extend to secure the entire molded case circuit breaker housing 1 to a panel or other mounting structure (not shown). In addition, the secondary cover 21, primary cover 7 and base 3 have aligned line terminal holes 39, 41 and 43, respectively, through which a tool such as a screw driver or Allen wrench (not shown) can be inserted to tighten or loosen line terminals (not shown) mounted in the base 3. Similarly, load terminal holes 45 and 47 at the opposite ends of the secondary cover 21 in primary cover 7, respectively, permit access to load terminals (not shown) in recesses 49 in the base 3.

The secondary cover 21 is easily removable to provide access for installing, removing and servicing the auxiliary devices mounted in the cavities 17 and 19 in the primary cover 7. To this end, the secondary cover 21 is secured over the primary cover 7 by the attachment assembly 29. This attachment assembly 29 includes a plurality of studs 51 having the first end section 53 with a self-tapping thread 55. Each of the studs 51 is screwed into one of the mounting holes 31 in the primary cover 7 so that the self-tapping thread 55 non-rotatably fixes the stud in the primary cover 7 with a second end section 57 projecting upward from the top face 13. The second end section 57 of each of the studs 51 is provided with the first engagement member 59 in the form of a conventional thread such as a 6–32 thread. The stud 51 may have a central hexagonal section 60 for gripping the stud to secure it into a mounting hole 31 in the primary cover.

The attachment assembly 29 further includes a fastener 61 rotatably captured in each of the mounting holes 27 in the secondary cover 21. The fastener 61 preferably takes the form of a nut having an irregular head 63 for engagement by a tool. In practice, this irregular head 63 is polygonal and preferably hexagonal. The nut 61 also has an integral cylindrical collar 65 which is received in the associated mounting hole 21 and permits rotation of the fastener 61 relative to the secondary cover 7. The nut 61 is captured on the cover 7 by a retainer 67 in the form of an outwardly curled flair on the free end 69 of the collar 65. The nuts 61 have a central bore 71 and are provided with a second engagement member in the form of a thread 73 which is complimentary to the thread 59 on the second end of the stud. The exemplary fastener/nuts 61 were fabricated from hexagonal bar stock by turning down the collar with a lathe and drilling and tapping the central bore 71 to form the thread 73. The collar 65 is inserted through an associated mounting hole 27 in the top cover. In the secondary cover 21 and the flair or retainer 67 is formed either by a punch or by spinning as is well known. The nuts 61 are thereby secured to the secondary cover 7 but are freely rotatable relative to the secondary cover. Hence, the nut 61 cannot be misplaced or lost.

The secondary cover 21 is mounted on the primary cover 7 to enclose the cavities 17 and 19 by seating the secondary cover 21 on the top face 13 of the primary cover 7 with the nuts 61 aligned with the second end section 57 of an associated stud 51. The nuts 61 are then rotated so that the thread 73 engage the thread 55 on the associated stud to firmly secure the secondary cover 21 in place. As the studs 51 and nuts 61 are made of durable material, such as steel, they do not appreciably wear with repeated installation and removal of the secondary cover. While the studs are secured to the molded primary cover by the self-tapping thread 55, the stud remains in place and is not rotated once installed so that the resin of the molded primary cover is not worn which would allow the stud to pull loose.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A molded case power switch housing comprising:

a molded base having an open top;

a primary cover extending over said open top and secured to said molded base to form an enclosure, said primary cover having at least one cavity formed in a top surface thereof;

a removable secondary cover which seats on said top face of said primary cover over said at least one cavity in said primary cover and has at least one mounting hole extending therethrough and;

an attachment assembly comprising;

at least one stud having a first end non-rotatably fixed in said primary cover and a second end projecting from said top face of said primary cover and into said at least one mounting hole in said secondary cover with said secondary cover seated on said primary cover, said second end having a first engagement member thereon; and at least one fastener captured in said at least one mounting hole in said secondary cover and having a second engagement member engaging and disengaging said first engagement member to secure said secondary cover and to release said secondary cover.

2. The molded case power switch housing of claim 1 wherein said at least one fastener is rotatably captured in said at least one mounting hole in said secondary cover for rotatable engagement and release of said first engagement member by said second engagement member.

3. The molded case power switch housing of claim 2 wherein said first engagement member on said second end of said at least one stud is a thread, and said at least one fastener is a nut and said second engagement member is a complimentary thread in said nut.

4. The molded case power switch housing of claim 3 wherein said at least one nut has a non-circular head and a cylindrical collar seated in said at least one mounting hole in said secondary cover, and a retainer on a free end of said collar capturing said collar in said at least one mounting hole.

5. The molded case power switch housing of claim 4 wherein said retainer comprises a radially outward flair on said free end of said collar.

6. The molded case power switch housing of claim 5 wherein said non-circular head on said nut is polygonal in cross-section.

7. The molded case power switch housing of claim 6 wherein said non-circular head is hexagonal in cross-section.

8. The molded case power switch housing of claim 3 wherein said first end of said at least one stud has a self-tapping thread which engages said primary cover.

9. The molded case power switch housing of claim 1 wherein said first end of said at least one stud has a self-tapping thread which engages said primary cover.

10. The molded case power switch housing of claim 1 wherein said at least one mounting hole in said secondary cover comprises a plurality of mounting holes, and said at least one stud comprises a plurality of studs each having a first end non-rotatably fixed in said primary cover and a second end projecting from said top face of said primary cover and into an aligned mounting hole in said secondary cover, and wherein said at least one fastener comprises a plurality of fasteners each rotatably captured in an associated mounting hole in said secondary cover.

11. The molded case power switch housing of claim 10 wherein said first engagement member on each of said plurality of studs comprises a thread, and wherein each of said plurality of fasteners comprises a nut captured in an associated mounting hole in said secondary cover and having complimentary threads.

12. The molded case power switch housing of claim 11 wherein each of said nuts have a cylindrical collar received in the associated mounting hole in said secondary cover with an outwardly flared free end capturing said nut in said associated mounting hole.

* * * * *